US006725613B2

(12) United States Patent
Oliver et al.

(10) Patent No.: US 6,725,613 B2
(45) Date of Patent: Apr. 27, 2004

(54) CONNECTOR FOR MANUFACTURED HOME SIDEWALL ANCHOR STRAP

(76) Inventors: James Oliver, P.O. Box 9, Hohenwald, TN (US) 38462; Evon L. Oliver, P.O. Box 9, Hohenwald, TN (US) 38462

( * ) Notice: Subject to any disclaimer, the term of this patent is extended or adjusted under 35 U.S.C. 154(b) by 0 days.

(21) Appl. No.: 10/083,880

(22) Filed: Feb. 26, 2002

(65) Prior Publication Data

US 2002/0083660 A1 Jul. 4, 2002

Related U.S. Application Data

(63) Continuation-in-part of application No. 09/711,727, filed on Nov. 14, 2000, now Pat. No. 6,418,685.

(51) Int. Cl.[7] ..... E02D 27/50

(52) U.S. Cl. ..... 52/169.9; 52/293.3; 52/148; 52/23; 248/503; 248/499

(58) Field of Search ..... 52/293.3, 169.9, 52/DIG. 11, 23, 148, 157; 248/499, 503; 24/199

(56) References Cited

U.S. PATENT DOCUMENTS

| | | | | | |
|---|---|---|---|---|---|
| 3,017,679 | A | * | 1/1962 | Elsner | 410/116 |
| 3,222,739 | A | | 12/1965 | Davis | 24/75 |
| 3,267,537 | A | | 8/1966 | de Claire et al. | 24/75 |
| 3,894,365 | A | * | 7/1975 | Abbott | 52/23 |
| 3,937,436 | A | * | 2/1976 | Stewart | 248/499 |
| 4,257,570 | A | | 3/1981 | Rasmussen | 248/503 |
| 5,697,191 | A | * | 12/1997 | MacKarvich | 52/169.9 |
| 5,701,715 | A | * | 12/1997 | Masters et al. | 52/698 |
| 5,836,060 | A | | 11/1998 | Profit | 24/698.2 |
| 5,983,573 | A | | 11/1999 | MacKarvich | 52/23 |
| 6,176,056 | B1 | | 1/2001 | MacKarvich | 52/293.3 |
| 6,247,276 | B1 | | 6/2001 | Masters et al. | 52/169.12 |
| 6,256,940 | B1 | | 7/2001 | MacKarvich | 52/126.6 |
| 6,343,449 | B1 | * | 2/2002 | MacKarvich | 52/293.3 |

* cited by examiner

*Primary Examiner*—Winnie S. Yip
(74) *Attorney, Agent, or Firm*—Calif Tervo

(57) ABSTRACT

A connector (20) for quickly and easily connecting an anchor strap (50) having an upper end (52) and a lower end (56) to a sidewall bracket (73) of a manufactured home (70); the sidewall bracket 70 having an elongate horizonal slot (77). Connector (20) includes a central portion (22) including a cut (44) for connecting strap (50). An attachment portion (30), including a neck (31) and a head (34), is adapted to be maneuverable for easy attachment to slot (77). Attached connector (20) is pivotable about an axis substantially perpendicular to an attached tensioned strap (50). A connector assembly (10) includes strap (50) already attached to connector (20). The method of using connector assembly (10) includes attaching strap (50) to an anchor (80).

6 Claims, 2 Drawing Sheets

CONNECTOR FOR MANUFACTURED HOME SIDEWALL ANCHOR STRAP

CROSS-REFERENCE TO RELATED APPLICATIONS

This application is a continuation-in-part of application Ser. No. 09/711,727, filed Nov. 14, 2000 now U.S. Pat. No. 6,418,685.

FIELD OF THE INVENTION

This invention relates to a connector for quickly and easily attaching an anchor strap to a sidewall bracket of a manufactured home; the sidewall bracket adapted for attachment of an anchor strap. Additionally, the connector can pivot to prevent stress concentrations in the anchor strap.

BACKGROUND OF THE INVENTION

Manufactured homes, such as mobile homes, trailers, and prefabricated homes, are manufactured at a factory and moved to a site where they are "set up," that is placed on supports, such as blocks or piers. Typically, to secure the manufactured home during transit, a plurality of sidewall brackets are attached to the manufactured home's lower support frame. Sidewall brackets are typically attached at least every 5–6 feet around the periphery of the manufactured home. Each sidewall bracket includes means, such as a slot, for attachment of a tie down strap, and the tie down straps secure the home to the transport vehicle. Later these sidewall brackets are used to tether the manufactured home to the ground. Anchor straps are typically elongate thin wide steel straps.

Upon setup, attaching anchor straps to all of the sidewall brackets is very time consuming. Therefore, it would be desirable to have a device for facilitating faster attachment of anchor straps.

Additionally, in the field upon setup, strap connections, such as clamps, are difficult to uniformly execute such that such connections are more likely to fail when stressed. Therefore, it is desirable to have a means for reducing the number of connections made in the field.

Also, a problem arises should the manufactured home move, such as a result of an earthquake or hurricane, in a direction substantially in the plane of the anchor strap. As the home moves, the edge of the strap on the side away from the movement is highly stressed such that failure typically results. Thus, current anchor straps attempt to prevent the home from movement, but once the home does move, the straps tend to break, such that they provide no further securing. Therefore, it is desirable to have an anchor strap that does not fail should the home shift a small distance such that the home is provided some protection against further movement.

SUMMARY OF THE INVENTION

This invention is a connector for quickly and easily connecting an anchor strap to a sidewall bracket of a manufactured home; the sidewall bracket of the type having a front side, a rear side, and an elongate horizonal slot having a receiving surface, a width, and a height. The anchor strap has an upper end and a lower end.

The connector includes a central portion including an upper end and a lower end, which includes means for connecting the upper end of the strap. An attachment portion includes a neck and a head. The neck has a width narrower than the width of the slot, a height less than the height of the slot, a first end connected to the central portion, and a second end. The head is connected to the second end of the neck and includes a dimension greater than the width of the slot.

The attachment portion is adapted to be maneuverable, when not tensioned, between an unattached position and an attached position wherein the neck resides in the slot, the head and body are on opposite sides of the bracket, and the head will not pass through the slot when the strap is tensioned. In the attached position, the neck is pivotable in the slot about an axis substantially perpendicular to an attached tensioned strap.

A connector assembly includes the strap already attached to the connector.

The method for anchoring the sidewall bracket to a ground anchor comprises the steps of: providing a connector assembly including: a connector including: an attachment portion connectable to the slot with a rotating maneuver; and an elongate strap having a connection end connected to the connector and an anchor end; wherein an attached connector is pivotable in the slot about an axis substantially perpendicular to an attached tensioned strap; connecting the connector to the slot by rotating the connector such that the attachment portion connects through the slot; connecting the anchor end of the strap to an anchor; and tensioning the strap.

Other features and many attendant advantages of the invention will become more apparent upon a reading of the following detailed description together with the drawings wherein like reference numerals refer to like parts throughout.

DETAILED DESCRIPTION OF THE INVENTION

Figures 1, 2:
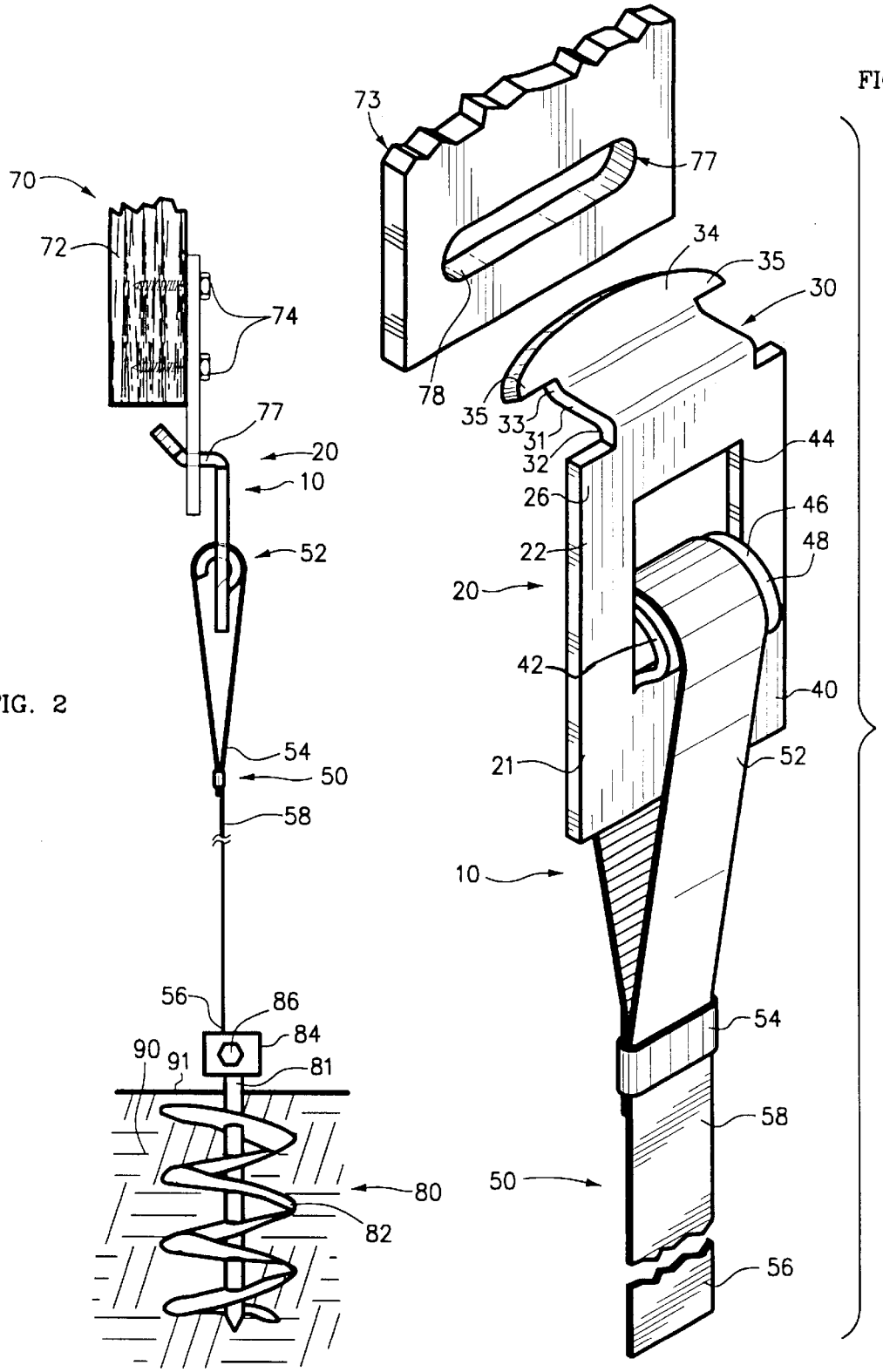
FIG. 1 is a top front perspective view, partially cut away, of a preferred embodiment of a connector assembly of the invention and a manufactured home sidewall bracket.
FIG. 2 is a reduced side elevation view, partially cut away, of the connector assembly of FIG. 1 attached to a ground anchor, shown reduced.
Figure 4:
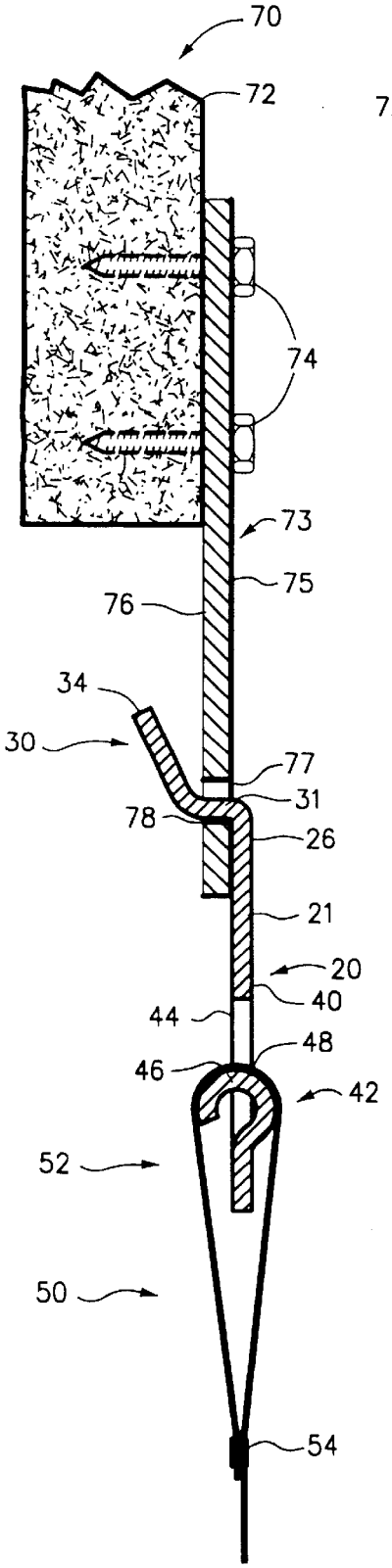
FIG. 4 is a side sectional view taken on line 4—4 of FIG. 3.
Figure 3:
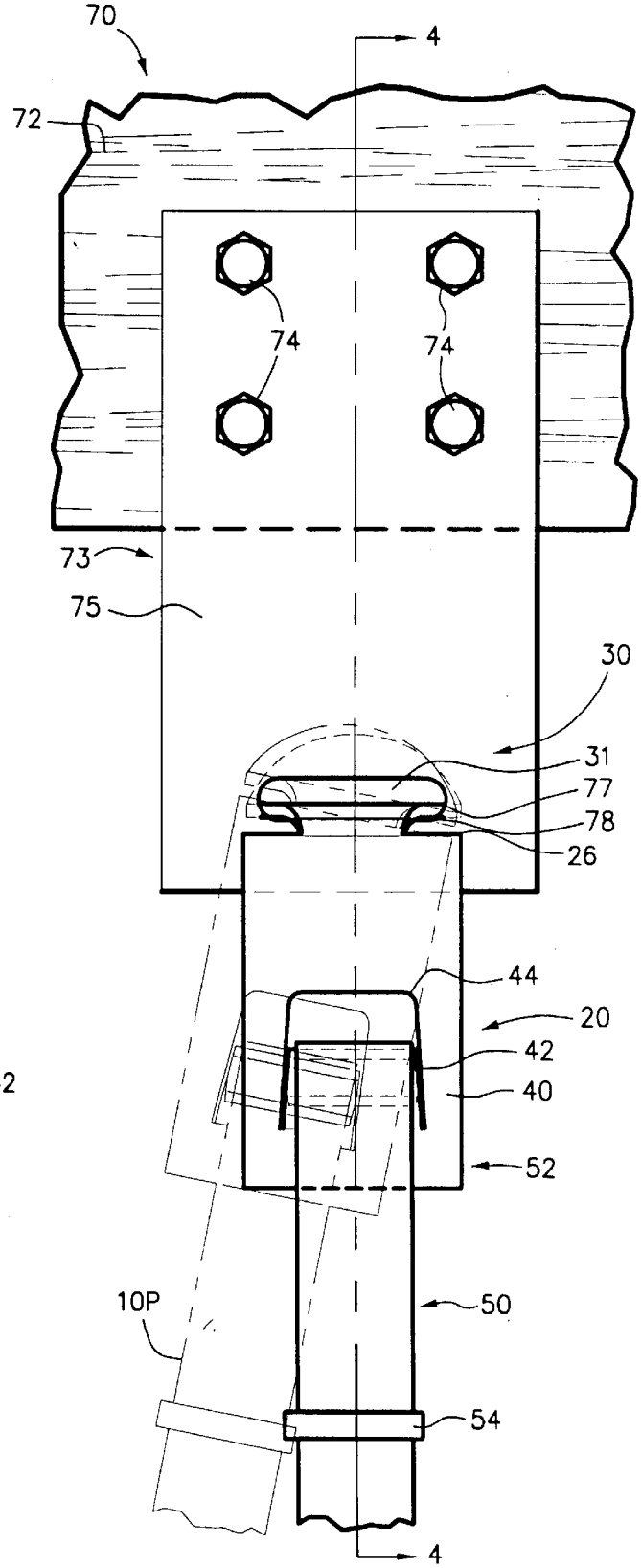
FIG. 3 is an enlarged front elevation view, partially cut away, of the connector assembly of FIG. 1.

With reference now to the drawings, FIG. 1 is a top front perspective view, partially cut away, of a preferred embodiment of a connector assembly 10 of the invention and a manufactured home sidewall bracket 73. FIG. 2 is a reduced side elevation view, partially cut away, of connector assembly 10 of FIG. 1 as attached to sidewall bracket 73 and a ground anchor 80, shown reduced. FIG. 3 is an enlarged front elevation view, partially cut away, of connector assembly 10 of FIG. 1. FIG. 4 is a side sectional view taken on line 4—4 of FIG. 3.

A manufactured home 70, shown mostly cut away, is supported by means well-known in the art and includes a frame, such as lower support frame 72. Frame 72 is typically a strong beam of wood about the periphery of manufactured home 70.

Sidewall bracket 73 is attached by attachment means, such as by carriage screws 74, to frame 72. Sidewall bracket 73 is typically a rectangular piece of steel having a thickness of one-eight inch or more. Sidewall bracket 73 has a front side 75, a rear side 76, and includes a through slot 77 designed for receiving an anchor strap. Slot 77 is elongate and horizonal and has a width and a height and includes a receiving surface 78 for receiving an anchor strap 50.

An anchor, such as ground anchor 80, as is well-known in the art, is located below bracket 73 and is secured to ground 90. A typical ground anchor 80 includes a shaft 81 with helical blades 82 screwed into ground 90 and a head 84 left above ground surface 91 including strap attachment and tensioning means, such as split bolt 86.

Connector assembly 10 generally includes a connector 20 connected to bracket 73 and an anchor strap 50 connecting connector 20 to anchor 80. Anchor strap 50 includes a connection end or upper end 52 connected to connector 20, an anchor end or lower end 56 attached to split bolt 86 of anchor 80, and a central section 58 therebetween. Anchor strap 50 is of conventional design being an elongate, wide, solid flat metal strap, such as of high tension steel. Upper end 52 is looped through connector 20 and attached to itself with suitable attachment means, such as by clamp 54. Lower end 56 is inserted in split bolt 86, which is turned to capture and tension strap 50 as is well-known in the art. Strap 50 has a length and width defining a strap plane.

Connector 20 includes a body 21 including a central portion 22. Central portion 22 includes an upper end 26 and a lower end 40. Lower end 40 includes strap receiving means 42 for connection of upper end 52 of anchor strap 50. Strap receiving means 42 provides for connection of strap 50 and includes an upside-down U-shaped cut 44 with the inner U-material 46 bent in a curve to provide a large curved surface 48 for receiving strap 50.

Connector body 21 includes an attachment portion 30 connected to central portion 22 including a neck 31 and a head 34. Neck 32 has a width narrower than the width of slot 77 and a first end 32 connected to upper end 26 of central portion 22 and a second end 33 connected to head 34. Head 34 includes a barb 35 on each side; each barb 35 protruding laterally outward from neck 31 such that the combined width of neck 31 and barb 35 is less than the width of slot 77 such that attachment portion 30 is maneuverable, when the connector is not under tension, such as from strap 50, between an unattached position, as shown in FIG. 1, and an attached position, as shown in FIGS. 3–4 wherein neck 31 resides in slot 77 and head 34 and body 21 are on opposite sides of bracket 73. In the attached position, head 34 will not pass through slot 77 when tension is applied to connector 20, such as by strap 50.

Connector assembly 10P is shown in phantom in FIG. 3 in the attached position. Neck 31 is pivotable in slot 77 about an axis substantially perpendicular to the plane of an attached strap 50 even when strap 50 is under tension. The angle through which connector 20 may pivot is typically in the range of 10°–20°, which will allow for any slight shifting of manufactured home 70 in a direction substantially parallel to the plane of strap 50. Thus, if manufactured home 70 moves, such as a result of an earthquake or a hurricane, in a direction substantially in the plane of anchor strap 50, connector 20, through pivoting, prevents stress build along one side of strap 50 such that strap 50 will not break in this manner.

Preferably, connector assembly 10 is configured in the factory. That is, an anchor strap 50 of known sufficient length is attached to connector 20 as shown and clamped with clamp 54. Attaching strap 50 to connector 20 at the factory assures that the connection is to specifications whereas attachment in the field is subject to much greater variation.

In use, to anchor manufactured home 70, an anchor is provided, such by auguring ground anchor 80 into ground 90. Connector 20 is attached to bracket 73 with a simple rotation. Strap 50 is inserted in split bolt 86 and tensioned by turning bolt 86. This is very fast and the only tool required is something to turn bolt 86.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A connector assembly for connecting an elongate anchor strap to a sidewall of a manufactured home; the anchor strap having an upper end and a lower end and a length and a width defining a plane; said connector assembly comprising:

a sidewall bracket having a front side and a rear side, and comprising:
an upper portion adapted for attachment to a sidewall of a manufactured home; and
a lower portion including:
an elongate horizontal slot having a horizontal lower receiving surface, a width, and a height; and a connector comprising:
a vertical body including:
a central portion including:
an upper end; and
a lower end including:
strap receiving means for connection of the upper end of the anchor strap; and
an attachment portion connected to said central portion and including:
a substantially horizontal neck extending outwardly substantially perpendicular to said central portion, said neck having a thickness less than the height of said slot and a width narrower than the width of said slot; said neck including:
a first end connected to said upper end of said central portion of said vertical body; and
a second end; and
a head connected to and extending upwardly from said second end of said neck; said head having a width greater than the width of said slot and adapted to be maneuverable, when said connector is not connected to a tensioned strap, said head is passed through said slot to an attached position wherein said head and body are on opposite sides of said bracket; and when said connector is connected to a tensioned strap, said head will not pass through said slot and said neck is disposed in said slot and bears against said horizontal receiving surface of said slot and is pivotable in said slot about an axis substantially perpendicular to the plane of an attached tensioned strap.

2. A connector assembly for anchoring a sidewall of a manufactured home to an anchor; said connector assembly comprising:

an elongate anchor strap having a length and a width defining a plane and including:
an anchor end for connection to an anchor; and
an upper end:

a sidewall bracket having a front side and a rear side, and comprising:

an upper portion adapted for attachment to a sidewall of a manufactured home; and a lower portion including:

an elongate horizontal slot having a horizontal lower receiving surface, a width, and a height; and a connector comprising:

a vertical body including:

a central portion including:

an upper end; and a lower end including:

strap receiving means connected to said upper end of said anchor strap; and an attachment portion connected to said central portion; said attachment portion including:

a substantially horizontal neck extending outwardly substantially perpendicular to said central portion, said neck having a thickness less than the height of said slot and a width narrower than the width of said slot; said neck including:

a first end connected to said upper end of said central portion of said vertical body; and a second end; and a head connected to and extending upwardly from said second end of said neck; said head having a width greater than the width of said slot and adapted to be maneuverable, when said strap is not tensioned, between an unattached position and an attached position wherein said head is passed through said slot, and said neck resides in said slot, said head and said body are on opposite sides of said bracket, an said head will not pass through said slot when said strap is tensioned; wherein, in the attached position, said neck is disposed in said slot and bears against said horizontal receiving surface of said slot and is pivotable in said slot about an axis substantially perpendicular to the plane of said attached tensioned strap.

3. In combination:

a manufactured home including:

a support frame;

a sidewall bracket attached to said support frame; said sidewall bracket having a front side, a rear side, and including:

an elongate horizontal slot therethrough having a width and a height and including:

a receiving surface;

an elongate anchor strap having a connection end and an anchor end; and a connector for connecting said anchor strap to said sidewall bracket; said connector comprising:

a body including:

a central portion including:

an upper end; and a lower end including:

strap receiving means for connection of said connection end of said anchor strap; and an attachment portion connected to said central portion including:

a neck extending outwardly substantially perpendicular to said central portion, said neck having a width narrower than the width of said slot; said neck including:

a first end connected to said central portion; and a second end; and a head connected to and extending upwardly from said second end of said neck; wherein: said attachment portion is maneuverable, when said connector is not under tension, between an unattached position and an attached position wherein said head is passed through said slot, said neck resides in said slot and said head and body are on opposite sides of said bracket, and said head will not pass through said slot when said strap is tensioned; wherein, in the attached tensioned position, said neck is pivotable in said slot about an axis substantially perpendicular to an attached tensioned strap.

4. The connector of claim 3 wherein:

the thickness of said neck is less than the height of said slot.

5. The connector of claim 3 wherein:

said head has a dimension greater than the width of said slot.

6. A method for anchoring a manufactured home having a sidewall bracket having: a front side; a rear side; and an elongate horizontal slot having: a horizontal receiving surface; a width; and a height; to an anchor strap having a length and a width defining a plane; the method comprising the steps of:

providing a connector including:

a vertical body including:

a central portion including:

an upper end; and a lower end including:

strap receiving means for connection of the upper end of the anchor strap; and an attachment portion connected to the central portion and including:

a substantially horizontal neck extending outwardly substantially perpendicular to said central portion, said neck having a thickness less than the height of the slot and a width narrower than the width of the slot; the neck including:

a first end connected to the upper end of the central portion of the vertical body; and a second end; and a head connected to and extending upwardly from the second end of the neck; the head having a width greater than the width of the slot; the head being maneuverable, when the connector is not connected to a tensioned strap, said head is passed through the slot to an attached position wherein the head and body are on opposite sides of the bracket; and when the connector is connected to a tensioned strap, the head will not pass through the slot and the neck is disposed in the slot and bears against the horizontal receiving surface of the slot and is pivotable in the slot about an axis substantially perpendicular to the plane of an attached tensioned strap;

connecting the connector to the slot by rotating the connector such that the head connects through the slot;

connecting the anchor strap to the strap receiving means of the connector; and tensioning the strap on the connected connector.

* * * * *